United States Patent [19]

Iwao

[11] 4,108,952

[45] Aug. 22, 1978

[54] VARIABLE VENTURI TYPE ENGINE CARBURETOR

[75] Inventor: Suminari Iwao, Saitama, Japan

[73] Assignee: Honda Giken Kogyo Kabushiki Kaisha, Japan

[21] Appl. No.: 789,456

[22] Filed: Apr. 21, 1977

[30] Foreign Application Priority Data

Apr. 23, 1976 [JP] Japan ..... 51-51186[U]

[51] Int. Cl.[2] ..... F02M 9/06

[52] U.S. Cl. ..... 261/44 R

[58] Field of Search ..... 261/44 R

[56] References Cited

U.S. PATENT DOCUMENTS

| | | | |
|---|---|---|---|
| 2,062,496 | 12/1936 | Brokel | 261/44 R |
| 3,243,167 | 3/1966 | Winkler | 261/44 R |

FOREIGN PATENT DOCUMENTS

| | | | |
|---|---|---|---|
| 27,405/69 | 11/1969 | Japan | 261/44 R |
| 300,725 | 11/1928 | United Kingdom | 261/44 R |

*Primary Examiner*—Tim R. Miles

*Attorney, Agent, or Firm*—Polster, Polster and Lucchesi

[57] ABSTRACT

A variable venturi type carburetor for motor cycle and the like which is constructed with a carburetor main body, an air intake passageway formed in the carburetor main body, a piston type throttle valve provided in the air intake passageway and which also serves as a variable venturi, a pressure receiving part provided on the upper part of the throttle valve and having a function of opening the throttle valve upon its receipt thereinto of an intake negative pressure of the engine, a control lever for the throttle valve opening and closing which is supported on the rotational shaft within the pressure receiving part and restricts the throttle valve to a predetermined degree of opening by closing and opening of the valve in association with the throttle valve operation, and compulsory valve opening device interposed between the throttle valve and the throttle valve operating and interlocking system, the compulsory valve opening device following movement of the control lever for opening and closing the throttle valve and having a function of forcibly opening the throttle valve from its lowest degree of opening to a predetermined degree of opening when the control lever moves toward the throttle valve opening direction.

10 Claims, 3 Drawing Figures

1
2
2₁
2₂
3
4
5
6
7
8
9
10
11
11₁
12
13
14
15
17
18
19
20
21
22
23
24
25
26
27
28
29
30
31
32
33

1
2
2₁
2₂
3
4
5
6
7
8
9
10
11
11₁
12
13
14
15
17
18
19
20
21
22
23
24
25
26
27
28
29
30
31
32
33

VARIABLE VENTURI TYPE ENGINE CARBURETOR

BACKGROUND OF THE INVENTION a. Field of the Invention

The present invention relates to a carburetor for an engine in an automotive vehicle such as a motorcycle, and the like, and, more particularly, it is concerned with an improvement in a variable venturi type carburetor for such engine, in which a piston type throttle valve serving also as a variable venturi is opened and closed by a negative pressure to be created at the time of air-intake into the engine so as to automatically vary the diameter of the venturi.

b. Description of Prior Art

For this kind of engine carburetor, there has so far been known such a construction that, by turning the handle grip of the motorcycle to operate the throttle, a control lever for opening and closing the throttle valve is caused to rotate to release the closed state of the piston type throttle valve, then a negative pressure created in the air intake passageway is introduced into a pressure receiving part provided on the upper part of the throttle valve through a passage formed in the throttle valve, by the negative pressure of which the throttle valve is opened, the degree of opening of the throttle valve being able to be restricted by its contact to the abovementioned control lever.

In the above-described carburetor, since the transition characteristic at the changing period of the degree of opening of the throttle valve is automatically determined by the negative pressure caused by the air intake of the engine, unless the closure state of the throttle valve is released, the number of revolutions of the engine increases augment the negative pressure at the air intake, the throttle valve is not raised, so that the venturi diameter remains small. And, following increase in the negative pressure at the air intake, the throttle valve is raised for an amount corresponding to the negative pressure value to increase the cross-sectional area of the venturi, and the throttle valve finally contacts the control lever for its opening and closing to maintain the stabilized degree of the throttle opening at that position.

Thus, the above-described throttle valve functions as the variable venturi in response to the negative pressure value at the air intake of the engine in its transitional state where the closure of the throttle valve is released, while it functions as the valve for regulating the maximum value of an amount of intake mixture air when it is at the stabilized position. Therefore, this type of variable venturi type carburetor has such advantage that it can stably and accurately increase speed without stoppage of the engine no matter how abrupt the speed acceleration in the engine might be.

On the other hand, when the time required for the speed acceleration is taken into consideration, no acceleration takes place by an abrupt accelerating operation, unless the negative pressure at the air intake of the engine increases. As the consequence, an additional time is required for this increase in the negative pressure until the speed acceleration is actually attained, on account of which there has remained a point of problem such that the feeling of the speed acceleration cannot be denied.

Besides the above, it has so far been ascertained that, in the variable venturi type carburetor wherein the throttle valve is opened and closed by a cable, when the grip handle is abruptly operated or turned to bring the throttle valve to its full open state, the speed acceleration is frequently failed to cause stoppage in the engine running, but, with respect to the speed accelerating operation for an intermediate degree of opening of the throttle valve, the number of revolutions of the engine gradually increases in pursuance of the speed accelerating operation with the consequence that there occurs no failure in the speed acceleration in the engine running. The reason for this is that, when the throttle valve abruptly opens to its full extent, the intake amount of air which is light in weight can immediately follow the variation in the degree of the valve opening to increase its quantity, while the fuel which is heavier in weight than air is delayed in time for its suction owing to difference in inertia between the intake air and the fuel flowing in the air intake passageway with the consequence that the mixing ratio between the air and the fuel becomes excessively thin and combustion of the mixed gas in the engine becomes unable to be continued. On the contrary, when the throttle valve is opened to its intermediate degree of opening, the increased portion in the amount of the intake air following the variation in the degree of opening of the throttle valve is smaller than that at its full open condition, so that the above-described tendency accrues.

SUMMARY OF THE INVENTION

In view of the afore-mentioned points of problem and the phenomenon, it is a primary object of the present invention to provide a variable venturi type carburetor having a satisfactory speed accelerating characteristic, and which is provided with a mechanism for compulsory opening of the throttle valve, the provision of which is the feature in the negative pressure responding type carburetor, wherein the throttle valve is opened and closed by a cable at the initial stage of speed acceleration.

It is another object of the present invention to provide a variable venturi type carburetor which has sufficient durability and which accommodates the compulsory throttle valve opening mechanism within a pressure receiving portion thereof without the same being exposed outside.

It is still another object of the present invention to provide the variable venturi type carburetor having a mechanism which is capable of adjusting the degree of opening of the throttle valve outside and in an easy manner at the initial stage of the speed accelerating operation in accordance with the characteristic of the engine.

According to the present invention, generally speaking, there is provided a variable venturi type carburetor which comprises in combination: a carburetor main body; an air intake passageway formed in said main body; a piston type throttle valve provided in said air intake passageway, said throttle valve also serving as a variable venturi; a pressure receiving part provided on the upper part of said throttle valve, and having a function of opening the throttle valve upon receipt thereinto of an intake negative pressure of the engine; a control lever for opening and closing said throttle valve which is held on a rotational shaft and closes the throttle valve and releases the closed state of the valve in associated movement with the throttle operation so as to restrict the valve opening to a predetermined degree; and means for compulsorily opening and closing the throttle valve which follows the movement of said control lever for opening and closing the throttle valve and has a function of compulsorily opening the throttle valve from its lowest degree of opening to a predetermined degree of opening when said control lever moves in the valve opening direction, said compulsory throttle valve opening means being provided between the interlocking or associated movement system for operating the throttle valve and said throttle valve.

There has thus been outlined, rather broadly, the more important features of the present invention in order that the detailed description thereof that follows may be better understood, and in order that the present contribution to the art may be better appreciated. There are, of course, additional features of the present invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

A specific embodiment of the invention has been chosen for the purpose of illustration and description, and is shown in the accompanying drawing, forming a part of the specification, in which.

DETAILED DESCRIPTION OF PREFERRED EMBODIMENT

In the following, specific and detailed explanations of the construction and operations of the variable venturi type carburetor according to the present invention will be given in reference to a preferred embodiment shown in the accompanying drawing.

Figure 1:
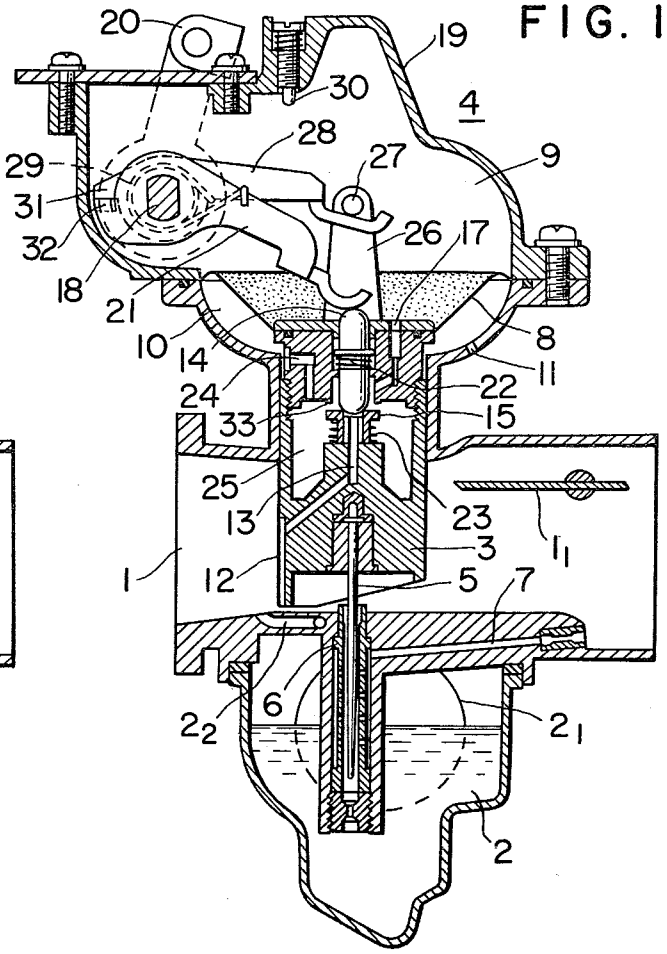
FIG. 1 is a longitudinal cross-sectional view of a preferred embodiment of the carburetor according to the present invention, in which the throttle valve is shown to be in the lowest degree of opening.
Figure 3:
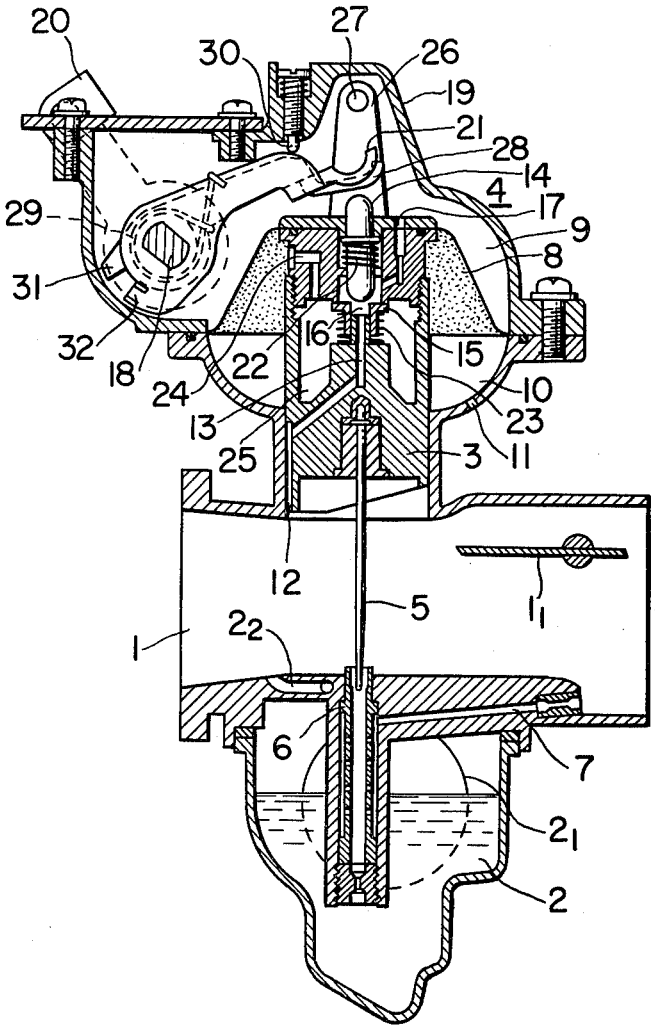
FIG. 3 is also the same longitudinal cross-sectional view of the carburetor shown in FIG. 1 above, in which the throttle valve is shown to be in its full open state.

Referring to FIG. 1, a reference numeral 1 designates an air intake passageway provided thoughout the carburetor main body. Beneath this air intake passageway, there is defined a float chamber 2. In confrontation to this float chamber 2, there is disposed a piston type throttle valve 3 which also serves as the variable venturi. On the top part of the throttle valve 3, there is provided a pressure receiving part 4 which receives therein the atmospheric pressure as well as a negative pressure created within the air intake passageway 1. A reference numeral $\mathbf{1}_1$ designates a choke valve. A jet needle 5 projects from the lower part of the abovementioned throttle valve 3 and intromits into a needle jet 6 which communicates to the float chamber 2, and air is supplied into the needle jet 6 through a breeding air passageway 7. Reference numerals $\mathbf{2}_1$ and $\mathbf{2}_2$ respectively designate a float and a pilot outlet. The abovementioned pressure receiving part 4 is divided in its interior into a pressure receiving chamber 9 and an atmospheric chamber 10 by means of a diaphragm 8, the inner peripheral part of which is fitted on the top part of the throttle valve 3 and the outer peripheral part of which is fitted on the inner periphery of the pressure receiving part 4. The interior of atmospheric chamber 10 is maintained at the atmospheric pressure through a passage port 11 formed in one part of the wall of the atmospheric chamber 10. A negative pressure created in the air intake passageway 1 is introduced into the above-mentioned pressure receiving chamber 9 interior through a negative pressure introducing passageway of the throttle valve 3 (i.e., a longitudinal groove 12 formed in the side surface of the throttle valve 3 to the side of the engine), a passageway 13, one end of which is open to the longitudinal groove 12, another passageway 16 formed by closure of a valve 15 for opening and closing the negative pressure introducing passageway, when a push pin 14 rises upward as shown in FIG. 3, to which the other end of the passageway 13 is open, and still another passageway 17 communicating to the passageway 16 and open to the pressure receiving chamber 9. A shaft 18 which pierces through the pressure receiving chamber 9 interior is rotatably held on the wall part of a cover 19. A throttle valve operating lever 20 which is interlocked with the handle grip operation through a wire which is fixed at a portion projecting from the rotational shaft 18 and the outside part of the cover 19. Also, in the pressure receiving chamber 9, one end part of a control lever 21 for opening and closing the throttle valve is fixed to the abovementioned rotational shaft 18. The other end part of the control lever 21 contacts the top part of the push pin 14 of the throttle valve 3. When the above-mentioned throttle valve operating lever 20 is at a position shown in FIG. 1, the control lever 21 acts to close the throttle valve 3 through the push pin 14. In this state, the push pin 14 compresses a coil spring 22 to open the valve 15 against a coil spring 23, with the consequence that both atmospheric chamber 10 and pressure receiving chamber 9 are in a communicative state through a passageway 24 of the throttle valve 3 open to the atmospheric chamber 10, a space 25 within the valve, and the passageway 17.

The above-described construction is concerned with the conventional carburetor, the point of problem of which, in such known construction, has been solved in accordance with the present invention by the provision with the above-mentioned known carburetor of a compulsory valve opening device which functions to forcibly open the throttle valve 3 from its minimum degree of opening to a predetermined one such as, for example, an intermediate degree of opening.

In a bit more detail, the above-mentioned compulsory opening means for the throttle valve is constructed with a member 26 which projects from the top surface of the valve, a pin 27 fixed at the tip end part of the projected member 26, a lever 28 for compulsorily opening the valve, one end of which is rotatably supported on the rotational shaft 18 of the control lever 21 for opening and closing the above-mentioned throttle valve, and the other end of which is engaged with the above-mentioned fixed pin 27 on its lower surface, a coil spring 29 which constantly imparts to the valve opening lever 28 a bias force in the valve opening direction, and a stopper 30 to restrict the rotational movement of the abovementioned compulsory valve opening lever 28 beyond its set position in the valve opening direction.

The coil spring 29 is fitted around the rotational shaft 18 of the control lever 21 for opening and closing the throttle valve, one end of which, in the shape of a letter L is hooked on the control lever 21 for opening and closing the throttle valve from above, and the other end of which, also in the shape of a letter L, is hooked on the compulsory valve opening lever 28 from below, thereby imparting bias force to both levers 21 and 28 which cause them to mutually open around the rotational shaft 18 as the center. On the opposite end of the engaged part with the fixed pin 27 of the compulsory valve opening lever 28, there is formed a projected part 31 which is engaged with another projected part 32 of the control lever 21 for opening and closing the throttle valve, which is formed in confrontation to the first-mentioned projected part 31.

The stopper 30 for restricting the rotational movement of the compulsory valve opening lever 28 is screw-fitted to the top part of the cover 19 so as to be positioned within the locus of rotation of the compulsory valve opening lever 28, and is so adjusted that it may contact the upper edge part of the lever 28, when the throttle valve 3 is at a position of an intermediate degree of opening. This stopper 30 can be adjusted from outside by arbitrarily forwarding and retracting in accordance with the engine characteristic.

Figure 2:
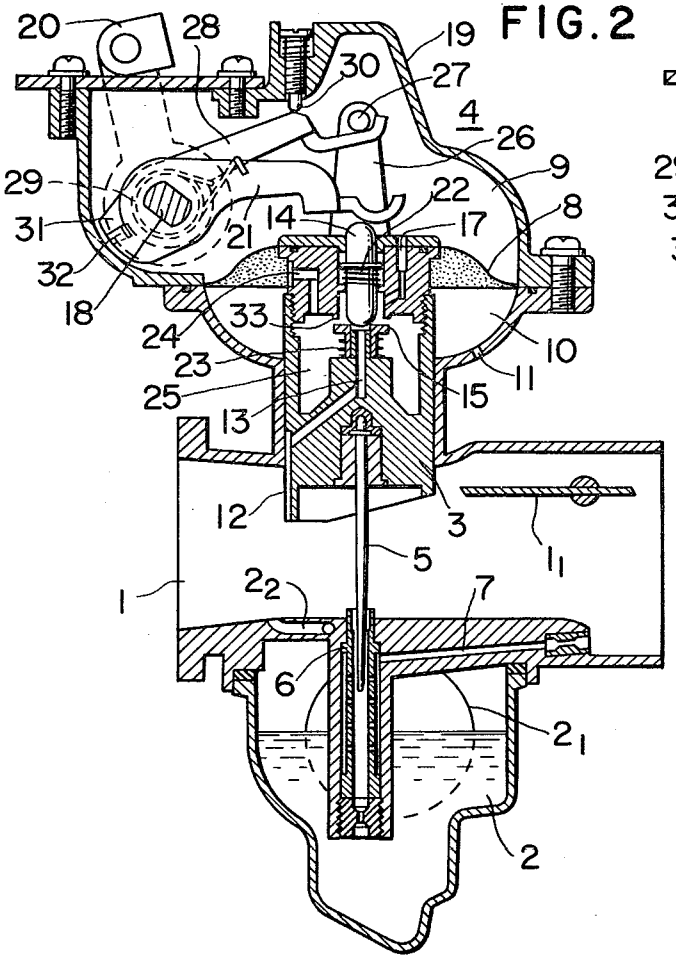
FIG. 2 is the same longitudinal cross-sectional view of the carburetor shown in FIG. 1 above, in which the throttle valve is shown to be an intermediate degree of opening.

Now, in the lowest degree of opening of the throttle valve 3 (which corresponds to the idling state of the engine) as shown in FIG. 1, when the handle grip is manipulated to cause the throttle valve operating lever 20 to rotate in the counter-clockwise direction, the control lever 21 for opening and closing the throttle valve and the compulsory valve opening lever 28 rotate in the counter-clockwise direction, whereupon the throttle valve 3 is forcibly opened through the pin 27. Such compulsory opening of the throttle valve 3 is continued until the compulsory valve opening lever 28 contacts the stopper 30 as shown in FIG. 2, that is, until the throttle valve reaches the intermediate degree of opening as set. As the result of this, the quantity of intake air into the engine increases, and the vehicle is rapidly accelerated from its lowest speed condition. At this time, the opening angles of both compulsory valve opening lever 28 and control lever 21 for opening and closing the throttle valve are maintained as they are by the action of the coil spring 29, whereby the valve 15 is in an open state by means of the control lever 21 through the pin 14, and the atmospheric air is still introduced into the interior of the pressure receiving chamber 9, hence rising of the throttle valve is not hindered.

When the throttle valve operating lever 20 is further rotated in the counter-clockwise direction, the compulsory valve opening lever 28 contacts the stopper 30 to cease its further rotation, and the control lever 21 for opening and closing the throttle valve rotates up to the full open position of the throttle valve, that is, the position shown in FIG. 3, while it is winding the coil spring 29. Since the pressure force imparted to the pin 14 is already released by the rotation of the control lever 21, the push pin 14 rises upward by the expanding force of the coil spring 22, and, along with this, the valve 15 also rises upward by the expanding force of the coil spring 23 to be in contact with the valve seat 33, whereby the negative pressure introducing passageway 16 is formed. In this consequence, the negative pressure within the air intake passageway 1 is introduced into the pressure receiving chamber 9 en route the passageway 12, 13, 16, and 17. On account of this negative pressure, the throttle valve 3 rises until the push pin 14 becomes in contact with the control lever 21 to thereby maintain a required degree of opening ranging from an intermediate to the full open state. Also, when the negative pressure increases beyond a regulated value due to fluctuation in load, the throttle valve 3 tends to further increase. In this case, however, since the control lever 21 is at a certain definite position, the push pin 14 gets in contact with the control lever 21 and moves downward against force of the coil spring 22 to separate the valve 15 from the valve seat 33 to release excessive negative pressure into the atmosphere, whereby the throttle valve 3 can be constantly maintained at a required degree of opening.

On the other hand, when the engine speed is to be reduced, the throttle valve operating lever 20 is rotated in the clockwise direction to lower the throttle valve 3 through the push pin 14, whereupon the valve 15 for opening and closing the negative pressure passageway is opened and the atmospheric air within the atmospheric chamber 10 is introduced into the pressure receiving chamber 9 en route the passageways 24, 25, and 17, whereby the throttle valve 3 lowers to the lowest degree of opening, i.e., to the state shown in FIG. 1. At this time, the compulsory valve opening lever 28 follows the movement of the control lever 21 by the action of the coil spring 29.

Since the carburetor according to the present invention is so constructed that the throttle valve 3 may be forcibly opened from its lowest degree of opening to an intermediate degree of opening as desired in pursuance of the movement of the control lever 21 for opening and closing the throttle valve, it becomes possible that any delay in response to the introduced negative pressure to the movement of the above-mentioned control lever is compensated, and initial speed acceleration characteristic of the engine ranging from the slowest operating speed to a desired intermediate operating speed can be attained satisfactorily by increasing the amount of intake air. In this way, any inconvenience such as stoppage of the engine due to failure in speed acceleration can be avoided. Also, by holding the compulsory valve opening lever 28 on the rotational shaft 18 of the control lever 21 within the pressure receiving chamber 9, the external appearance and construction of the carburetor become simple, and, at the same time, the negative pressure chamber 10 can be isolated from outside to avoid intrusion thereinto of dust and moisture. Also, no rust develops on the carburetor, so that it can always be operated in good condition. Further advantage with the present invention is that the set degree of opening can be easily adjusted from outside by the compulsory opening of the throttle valve in accordance with the engine characteristic.

By the way, in the above-described embodiment, one end of the coil spring 29 is engaged with the control lever 21 for opening and closing the throttle valve. However, it may also be fixed to the rotational shaft 18. Further, the above-mentioned coil spring 29 may be constructed in such a manner that one end thereof is fitted to the cover 19 and the other end thereof is fitted to the lever 28 so as to impart to it a constant rotational force in the counter-clockwise direction.

What is claimed is:

1. A variable venturi type carburetor comprising, in combination:

(a) a carburetor main body;

(b) an air intake passageway formed in said carburetor main body;

(c) a piston type throttle valve provided in the air intake passageway and which also serves as a variable venturi;

(d) a pressure receiving part provided on the upper part of said throttle valve, and having a function of opening the throttle valve upon receipt thereinto of an intake negative pressure of the engine;

(e) control means for opening and closing the throttle valve which is supported on the rotational shaft within said pressure receiving part, and restricts said throttle valve to a predetermined degree of opening by closing and opening the valve in association with the throttle valve operation; and (f) compulsory valve opening means interposed between said throttle valve and said throttle valve control means interlocked with the valve operation, said compulsory valve opening means following movement of said control means for opening and closing the throttle valve, and having a function of forcibly opening said throttle valve from its lowest degree of opening to a predetermined degree of opening when said control means moves toward the throttle valve opening direction.

2. The variable venturi type carburetor as set forth in claim 1, in which said compulsory valve opening means comprises: a projected member provided on the top surface of said throttle valve; a compulsory valve opening lever, one end of which is rotatably supported on the rotational axis of said control means for opening and closing the throttle valve, and the other end of which is engaged with said projected member; a resilient member which imparts to said compulsory valve opening lever a constant force in the valve opening direction; and a stopper to restrict rotational movement of said compulsory valve opening lever to the valve opening direction beyond the set position thereof.

3. The variable venturi type carburetor as set forth in claim 2, in which said resilient member is a coil spring which is loosely fitted around the rotational shaft of said control means for opening and closing said throttle valve, one end of said coil spring being fixed to said compulsory valve opening lever, and the other end thereof being fixed to said control means for opening and closing the throttle valve.

4. The variable venturi type carburetor as set forth in claim 2, in which said stopper is so constructed as to be capable of forwarding into and retracting from the pressure receiving part, whereby the positions of the compulsory valve opening lever for its rotational movement to the valve opening direction as well as stoppage may be adjusted.

5. The variable venturi type carburetor as set forth in claim 4, in which said stopper is a threaded screw which is screw-fitted into the wall of said pressure receiving part from outside.

6. In a variable venturi type carburetor constructed with a carburetor main body, an air intake passageway formed in said carburetor main body, a piston type throttle valve provided in the air intake passageway and which also serves as a variable venturi, a pressure receiving part provided on the upper part of said throttle valve, and having a function of opening the throttle valve upon receipt thereinto of an intake negative pressure of the engine, and control means for opening and closing the throttle valve which is supported on the rotational shaft within said pressure receiving part, and restricts said throttle valve to a predetermined degree of opening by closing and opening the valve in association with the throttle valve operation, IMPROVEMENT which comprises compulsory valve opening means interposed between said throttle valve and said throttle valve control means interlocked with the valve operation, said compulsory valve opening means following movement of said control means for opening and closing the throttle valve, and having a function of forcibly opening said throttle valve from its lowest degree of opening to a predetermined degree of opening when said control lever moves toward the throttle valve opening direction.

7. The improvement according to claim 6, in which said compulsory valve opening means comprises: a projected member provided on the top surface of said throttle valve; a compulsory valve opening lever, one end of which is rotatably supported on the rotational axis of said control means for opening and closing the throttle valve, and the other end of which is engaged with said projected member; a resilient member which imparts to said compulsory valve opening lever a constant force in the valve opening direction; and a stopper to restrict rotational movement of said compulsory valve opening lever to the valve opening direction beyond the set position thereof.

8. The improvement according to claim 7, in which said resilient member is a coil spring which is loosely fitted around the rotational shaft of said control means for opening and closing said throttle valve, one end of said coil spring being fixed to said compulsory valve opening lever, and the other end thereof being fixed to said control means for opening and closing the throttle valve.

9. The improvement according to claim 7, in which said stopper is so constructed as to be capable of forwarding into and retracting from the pressure receiving part, whereby the positions of the compulsory valve opening lever for its rotational movement to the valve opening direction as well as stoppage may be adjusted.

10. The improvement according to claim 9, in which said stopper is a threaded screw which is screw-fitted into the wall of said pressure receiving part from outside.

* * * * *